US006209805B1

(12) United States Patent
Male et al.

(10) Patent No.: US 6,209,805 B1
(45) Date of Patent: Apr. 3, 2001

(54) FUEL INJECTOR

(75) Inventors: Andrew Male, Crawley; Anthony Thomas Harcombe, Richmond, both of (GB)

(73) Assignee: Lucas Industries plc (GB)

( * ) Notice: Subject to any disclaimer, the term of this patent is extended or adjusted under 35 U.S.C. 154(b) by 0 days.

(21) Appl. No.: 09/312,508

(22) Filed: May 14, 1999

(30) Foreign Application Priority Data

Jun. 15, 1998 (GB) ..... 9812901

(51) Int. Cl.[7] ..... B05B 1/30

(52) U.S. Cl. ..... 239/585.1; 239/585.3; 239/585.5

(58) Field of Search ..... 237/88–92, 96, 237/533.1, 533.2, 533.3, 533.4, 533.5, 533.8, 533.9, 585.1, 585.3, 585.5; 251/30.01

(56) References Cited

U.S. PATENT DOCUMENTS

| | | | | |
|---|---|---|---|---|
| 4,221,192 | | 9/1980 | Badgley . | |
| 4,925,112 | * | 5/1990 | Wahba | 239/585.1 |
| 5,494,219 | * | 2/1996 | Maley et al. | 239/88 |
| 6,036,120 | * | 3/2000 | Varble et al. | 239/585.1 |

FOREIGN PATENT DOCUMENTS

| | | |
|---|---|---|
| 0 823 549 A2 | 2/1998 | (EP) . |
| 0 823 549 A3 | 6/1998 | (EP) . |
| 2 307 513 | 5/1997 | (GB) . |

* cited by examiner

*Primary Examiner*—Lisa Ann Douglas
(74) *Attorney, Agent, or Firm*—Andrus, Sceales, Starke & Sawall

(57) ABSTRACT

A fuel injector comprises a valve needle biased by a spring towards a seating. An electromagnetic actuator arrangement is operable to vary the magnitude of the biasing force applied to the needle by the spring.

10 Claims, 2 Drawing Sheets

FUEL INJECTOR

BACKGROUND OF THE INVENTION

This invention relates to a fuel injector for use in supplying fuel under pressure to a combustion space of a compression ignition internal combustion engine. In particular, the invention relates to a fuel injector of the type in which the commencement of injection is controlled using an electromagnetic actuator. The invention is particularly suitable for use in a pump/injector arrangement, but it will be appreciated that the invention may be used in other applications.

In a known pump/injector arrangement, the commencement of injection is controlled by controlling the fuel pressure within a control chamber, the fuel pressure within the control chamber applying a force to a valve needle urging the needle towards its seating. The fuel pressure within the control chamber is controlled using an appropriate electromagnetically actuated valve. Such an arrangement is relatively complex and difficult to control accurately.

SUMMARY OF THE INVENTION

According to the present invention there is provided a fuel injector comprising a valve needle biased by a spring towards a seating, and an electromagnetic actuator arrangement arranged to vary the magnitude of the biasing force applied to the needle by the spring.

In such an arrangement, the spring is conveniently arranged to apply a sufficiently large biasing force to the needle to ensure that injection does not occur when the actuator is energised to a first energization level. Upon energizing the actuator to a second energization level, the actuator acts against the spring to reduce the magnitude of the biasing force applied to the needle by the spring to a level sufficient to allow movement of the injector needle thus allowing injection to commence.

Preferably, the actuator includes an armature carried by a control member, the spring load being transmitted to the needle through the control member.

As the fuel injector does not rely upon the operation of a valve to control injection, the number of drillings, bores and other features which must be provided in the injector can be reduced thereby simplifying construction. The fuel injector is further relatively easy to control, thus permitting accurate control of the timing of injection.

The invention is particularly suitable for use in a pump/injector arrangement in which the timing of fuel injection relative to the timing of closing a drain valve controls the injection pressure. Clearly, in such an arrangement, the invention permits improved control of the injection pressure.

BRIEF DESCRIPTION OF THE DRAWINGS

The invention will further be described, by way of example, with reference to the accompanying drawings, in which.

DETAILED DESCRIPTION OF THE INVENTION

Figure 1:
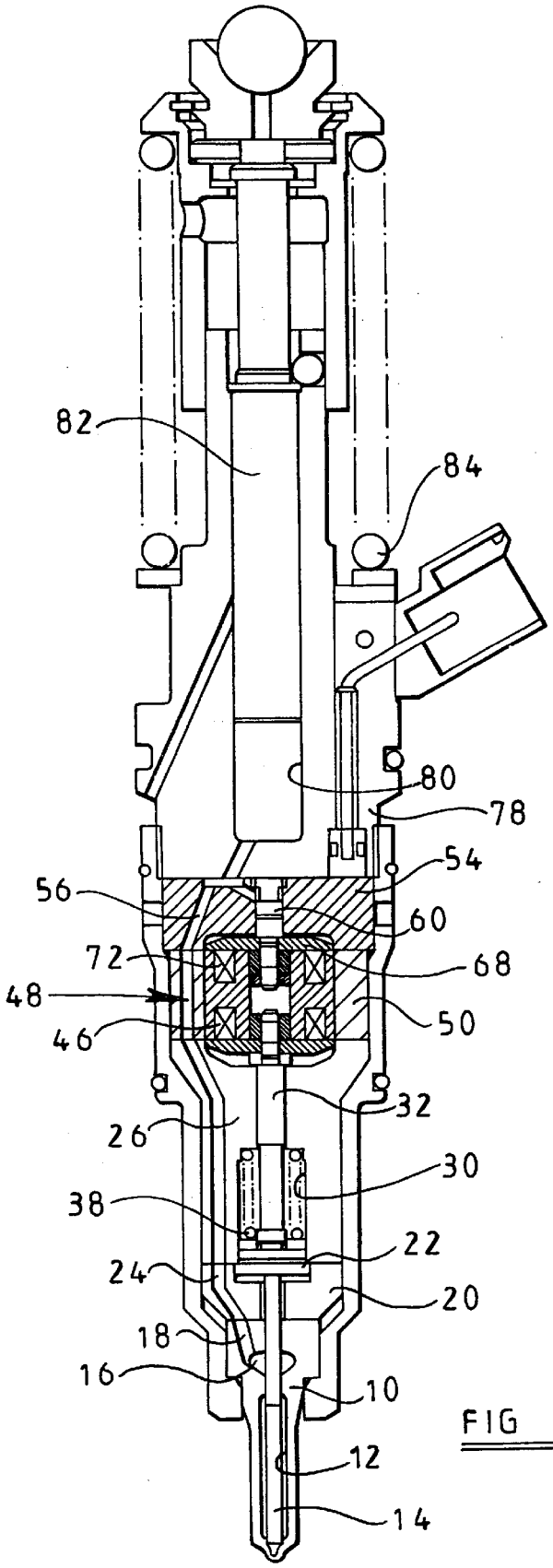
FIG. 1 is a sectional view of a fuel injector in accordance with an embodiment.
Figure 2:
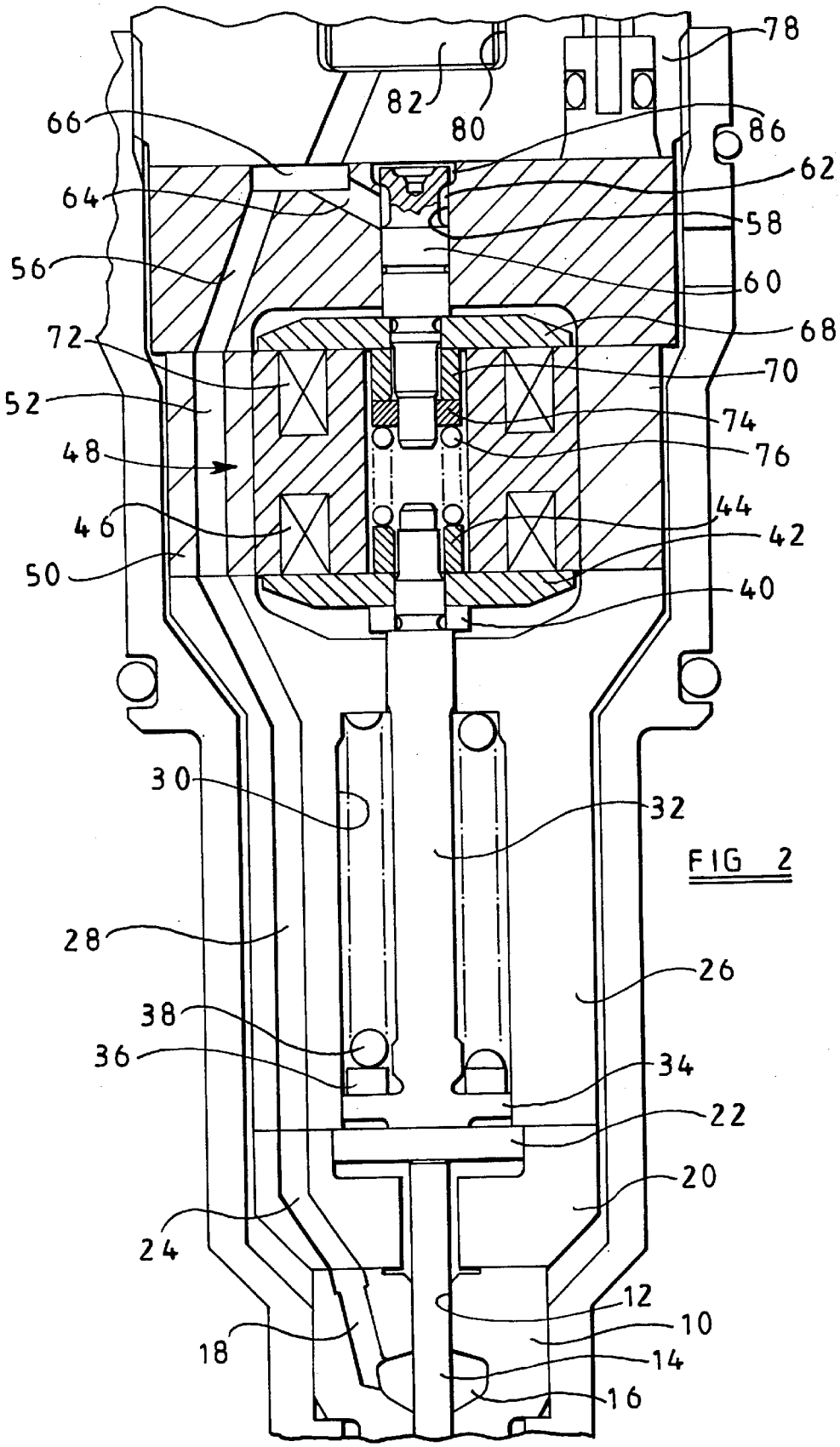
FIG. 2 is a view of part of the injector of FIG. 1 to an enlarged scale.

The fuel injector illustrated in the accompanying drawings comprises a nozzle body 10 which is provided with a blind bore 12. A valve needle 14 is slidable within the bore and is engageable with a seating defined adjacent the blind end of the bore to control communication between the bore 12 and one or more outlet openings which communicate with the bore 12 downstream of the seating. The bore 12 is shaped to define an upper region of diameter substantially equal to the diameter of the adjacent part of the needle 14 which guides the needle 14 for sliding movement in the bore 12. This part of the bore 12 is shaped to define an annular gallery 16 which communicates with a supply passage 18. The bore 12 further defines a lower region of enlarged diameter which houses a reduced diameter portion of the needle 14 and defines with the adjacent part of the needle 14, a chamber from which fuel is supplied, in use, past the seating to the outlet openings. The valve needle 14 is shaped to include a plurality of flutes which define flow paths between the annular gallery 16 and the chamber defined between the lower part of the bore 12 and the adjacent part of the needle 14. At the intersection between the upper, relatively large diameter part of the needle 14 and the reduced diameter part thereof, a thrust surface is defined which is exposed to the fuel pressure within the chamber.

The upper surface of the nozzle body 10 abuts a distance piece 20 which is provided with a through bore into which an end part of the needle 14 extends. A load transmitting member 22 engages the upper part of the needle 14 and is located in a part of the bore of the distance piece 20 of enlarged diameter. Drillings 24 are provided in the distance piece 20, the drillings 24 communicating with the supply passage 18.

The upper surface of the distance piece 20 abuts the lower end surface of a second distance piece 26 which is provided with drillings 28 communicating with the drillings 24 of the first distance piece 20. The second distance piece 26 is further provided with a through bore which includes a region of relatively large diameter defining a spring chamber 30. A control member 32 extends into the spring chamber, the lower end of the control member 32 including an outwardly extending flange 34, the upper surface of which carries a shim 36, a helical compression spring being engaged between a step defined at an end of the spring chamber 30 and the upper surface of the shim 36. The spring 38 biases the member 32 in a downward direction in the orientation illustrated, biasing the lower end surface of the member 32 into engagement with the load transmitting member 22, hence biasing the valve needle 14 into engagement with the seating.

The upper end of the control member 32 defines a step with which a shim 40 engages, the shim acting to locate an armature 42, a screw-threaded member 44 securing the armature 42 and shim 40 to the member 32. The armature 42 is moveable under the influence of a magnetic field generated, in use, by a first winding 46 forming part of an actuator arrangement 48 located within an actuator housing 50. A passage 52 extends through the actuator housing 50, the passage 52 communicating with the drillings 28.

The upper surface of the actuator housing 50 abuts a valve housing 54 which includes a drilling 56 communicating with the passage 52. The valve housing includes a through bore 58 within which a valve member 60 is slidable, the valve member 60 including a region which is dimensioned to engage a seating defined by part of the through bore 58. The through bore 58 and valve member 60 together define an annular chamber 62 located upstream of the seating which communicates through a drilling 64 and a recess 66 formed in the upper surface of the valve housing 54 with the drilling 56. The lower end of the valve member 60 is secured to an armature 68 by means of a screw-threaded member 70 which engages a screw-threaded part of the valve member 60. The armature 68 is moveable under the influence of a magnetic field generated, in use, by a second winding 72 forming part of the actuator 48.

A shim 74 is located beneath the screw-threaded member 70, a helical compression spring 76 being engaged between the shim 74 and the upper surface of the screw-threaded member 44.

The upper surface of the valve housing 54 abuts the lower end of a pump housing 78 which includes a bore 80 within which a pumping plunger 82 reciprocal under the influence of a cam and tappet arrangement, against the action of a return spring 84.

It will be appreciated that the shims 36, 40, 74 are selected depending upon the intended application of the injector, the shims setting the prestressing of the springs 38, 76 and the travel of the control member 32.

In use, whilst the plunger 82 is being withdrawn from the plunger bore 80 under the action of the spring 84, and with the first and second windings 46, 72 of the actuator 48 de-energized, the valve member 60 is biased by the spring 76 away from the seating, thus permitting communication between a source of fuel under low pressure which communicates with a chamber 86 located downstream of the seating and the plunger bore 80. As a result, fuel flows to the plunger bore 80, the flow of fuel continuing until the plunger 82 reaches its outermost position. It will be appreciated that during this stage of the operation of the injector, the fuel pressure applied to the valve needle 14, and in particular to the angled thrust surfaces thereof exposed to the fuel pressure within the bore 12, is relatively low. The force applied to the valve needle 14 by the application of fuel under pressure is therefore insufficient to lift the valve needle 14 away from its seating, the spring 38 acting to ensure that the valve needle 14 remains in engagement with the seating.

Once inward movement of the plunger 82 commences, whilst the actuator 48 remains de-energized, fuel is displaced from the plunger bore 80 past the valve member 60 and seating to the low pressure reservoir. When it is determined that pressurization of fuel should commence, the second winding 72 is energized resulting in movement of the armature 68 towards the winding 72 and bringing the valve member 60 into engagement with the seating. This movement breaks the communication between the plunger bore 80 and the low pressure fuel reservoir, and as fuel is no longer permitted to escape from the plunger bore 80, continued inward movement of the plunger 82 pressurises the fuel in the plunger bore 80 and passages in communication therewith. During this stage of the operation of the injector, although the fuel pressure applied to the needle 14 increases, the fuel pressure is still insufficient to cause movement of the valve needle away from its seating against the action of the spring 38.

When injection is to commence, the first winding 46 is energized attracting the armature 42 towards the winding 46. This attractive force is transmitted through the control member 32 to the spring 38, and it will be appreciated that as a result, the biasing force applied to the needle 14 by the spring 38 is reduced. The reduction in the biasing force applied to the needle 14 is sufficient to permit the valve needle 14 to lift from its seating under the action of the fuel pressure within the bore 12. Such movement of the needle 14 allows fuel to flow past the seating to the outlet openings, thus commencing injection.

In order to terminate injection, the second winding 72 is de-energized, and as a result the valve member 60 lifts away from its seating under the action of the spring 76. The movement of the valve member 60 permits fuel to escape to the low pressure fuel reservoir, thus permitting a rapid reduction in the fuel pressure within the plunger bore 80 and other passages within the injector. The fuel pressure applied to the needle 14 therefore falls, and as a result of the reduced pressure applied to the needle 14, the needle 14 returns into engagement with its seating under the action of the spring 38 to terminate injection. If desired, the first winding 46 may also be de-energized when the second winding 72 is de-energized, thus increasing the magnitude of the biasing force applied to the valve needle 14 by the spring 38 at the termination of injection.

After termination of injection, continued inward movement of the plunger displaces further fuel to the low pressure reservoir.

By ensuring that the attractive force between the first winding 46 and armature 42 rises as rapidly as possible, the timing at which commencement of injection occurs can be controlled relatively accurately, even allowing for slight inaccuracies in the effective area of the valve needle 14 exposed to the fuel pressure within the bore 12 urging the needle 14 away from its seating. As the timing of commencement of injection can be controlled relatively accurately, the injection pressure can also be controlled accurately using the apparatus described hereinbefore.

In an alternative mode of operation, rather than energizing the first winding 46 separately for each injection, the first winding 46 may be continuously energized to ensure that injection commences as soon as a predetermined pressure is reached, the predetermined pressure being dependent upon the rate of the spring 38, the magnitude of the attractive force between the actuator 48 and armature 42, and the effective area of the valve needle 14 exposed to the fuel pressure within the bore 12. In this mode of operation, the magnitude of the attractive force between the actuator 48 and the armature 42 can be varied, in use, to vary the pressure at which coramencement of injection occurs.

Although in the embodiments described hereinbefore, the invention is incorporated into a pump injector arrangement, it will be appreciated that the invention is also applicable to other types of fuel injector in which the commencement of injection is controlled electronically, the invention being applicable to arrangements both where the timing of commencement of injection is controlled and arrangements in which commencement of injection is to occur when a predetermined pressure is reached.

We claim:

1. A fuel injector comprising a valve needle biased by a biasing force applied by a spring towards a seating an electromagnetic actuator arrangement arranged to vary the magnitude of the biasing force applied to the needle by the spring and a valve operable to control a timing of commencement of fuel pressurization, wherein the valve includes a valve member slidable within a bore provided in a valve housing, the valve being engageable with a seating defined by the bore, and wherein the valve member and the bore together define a chamber for fuel which communicates with a source of fuel under low pressure, the valve member being engageable with the seating to control communication between a drilling provided in the valve housing and the chamber.

2. A fuel injector as claimed in claim 1, wherein the spring comprises a helical compression spring.

3. A fuel injector as claimed in claim 2, wherein the spring is arranged to apply a sufficiently large biasing force to the needle to ensure that injection does not occur when the actuator arrangement is energized to a first energization level, the actuator arrangement acting against the spring to reduce the magnitude of the biasing force applied to the needle by the spring to a level sufficient to allow movement of the valve needle thus allowing injection to commence when the actuator arrangement is energized to a second energization level.

4. A fuel injector as claimed in claim 3, wherein the actuator arrangement includes an armature carried by a control member which cooperates with the needle, the spring applying a load to the needle which is transmitted to the needle through the control member.

5. A fuel injector as claimed in claim 1, wherein the valve is controllable independently of the electromagnetic actuator arrangement.

6. A fuel injector comprising a valve needle biased by a biasing force applied by a spring towards a seating, an electromagnetic actuator arrangement arranged to vary the magnitude of the biasing force applied to the needle by the spring and a valve operable to control a timing of commencement of fuel pressurization, wherein the valve includes a valve member slidable within a bore provided in a valve housing, the valve being engageable with a seating defined by the bore, wherein the valve member and the bore together define a chamber for fuel which communicates with a source of fuel under low pressure, the valve member being engageable with the seating to control communication between a drilling provided in the valve housing and the chamber, and wherein the drilling provided in the valve housing communicates with a plunger bore within which a plunger is reciprocal, reciprocal movement of the plunger causing fuel pressurization within the plunger bore when the valve member is moved against the seating.

7. A fuel injector as claim in claim 6, wherein the spring comprises a helical compression spring.

8. A fuel injector as claimed in claim 7, wherein the spring is arranged to apply a sufficiently large biasing force to the needle to ensure that injection does not occur when the actuator arrangement is energized to a first energization level, the actuator arrangement acting against the spring to reduce the magnitude of the biasing force applied to the needle by the spring to a level sufficient to allow movement of the valve needle thus allowing injection to commence when the actuator arrangement is energized to a second energization level.

9. A fuel injector as claimed in claim 8, wherein the actuator arrangement includes an armature carried by a control member which cooperates with the needle, the spring applying load to the needle which is transmitted to the needle through the control member.

10. A fuel injector as claimed in claim 6, wherein the valve is controllable independently of the electromagnetic actuator arrangement.

* * * * *